US007516637B2

(12) United States Patent
Scamans et al.

(10) Patent No.: US 7,516,637 B2
(45) Date of Patent: Apr. 14, 2009

(54) METHOD AND APPARATUS FOR TEXTURING A METAL SHEET OR STRIP

(75) Inventors: Geoffrey M. Scamans, Cropredy (GB); Christopher J. Davenport, Rugby (GB); John A. Hunter, Bodicote (GB); Daniel B. Miller, Oxford (GB); David S. Wright, Rosdorf-Dramfeld (DE)

(73) Assignee: Novelis Inc., Toronto (CA)

( * ) Notice: Subject to any disclaimer, the term of this patent is extended or adjusted under 35 U.S.C. 154(b) by 216 days.

(21) Appl. No.: 10/471,617

(22) PCT Filed: Mar. 12, 2002

(86) PCT No.: PCT/GB02/01110

§ 371 (c)(1),
(2), (4) Date: Jan. 30, 2004

(87) PCT Pub. No.: WO02/072290

PCT Pub. Date: Sep. 19, 2002

(65) Prior Publication Data

US 2004/0112104 A1 Jun. 17, 2004

(30) Foreign Application Priority Data

Mar. 12, 2001 (GB) ..... 0105999.7
Nov. 8, 2001 (GB) ..... 0126851.5

(51) Int. Cl.
*B21B 1/00* (2006.01)
*B44B 5/00* (2006.01)

(52) U.S. Cl. ..... 72/187; 72/197

(58) Field of Classification Search ..... 72/187, 72/197, 198, 234, 200, 202, 199, 247.4, 241.6, 72/243.2; 148/690; 101/5, 6
See application file for complete search history.

(56) References Cited

U.S. PATENT DOCUMENTS 3,956,915 A * 5/1976 Saunders ..... 72/198

(Continued)

FOREIGN PATENT DOCUMENTS

EP 0456162 11/1991

(Continued)

OTHER PUBLICATIONS

Abstract of Japanese Patent Publication No. 05154504, Patent Abstracts of Japan, published Jun. 22, 1993.

(Continued)

*Primary Examiner*—Dana Ross
*Assistant Examiner*—Teresa Bonk
(74) *Attorney, Agent, or Firm*—Cooper & Dunham LLP

(57) ABSTRACT

There is provided a method of texturing a metal sheet or strip (8), which method comprises a plurality of sequential texturing passes each of which is performed by passing the sheet or strip (8) between at least one pair of rollers (7), wherein at least one of each pair of rollers (7) has a textured pattern on the surface thereof and the textured patterns are transferred to the sheet or strip (8) during each texturing pass, and wherein the textured surface on the sheet or strip (8) resulting from each pass overlaps with that from the one or more other passes to form a final textured pattern. There is also provided an apparatus for texturing a metal sheet or strip (8).

20 Claims, 9 Drawing Sheets

U.S. PATENT DOCUMENTS 5,025,547 A * 6/1991 Sheu et al. ..... 29/527.4
5,345,869 A * 9/1994 Treverton et al. ..... 101/454
5,471,731 A * 12/1995 Welhouse ..... 29/527.4
5,550,002 A * 8/1996 Kojima et al. ..... 430/258
5,807,659 A * 9/1998 Nishimiya et al. ..... 430/302
5,888,320 A * 3/1999 Dorward ..... 148/690
5,931,040 A * 8/1999 Kimura et al. ..... 72/234
5,998,044 A 12/1999 Limbach et al.
6,153,316 A * 11/2000 Shannon ..... 428/687
6,290,632 B1 * 9/2001 Blake et al. ..... 492/54
6,524,768 B1 2/2003 Limbach et al.
6,660,111 B2 12/2003 Taguchi et al.

FOREIGN PATENT DOCUMENTS

SU 1592063 9/1990
WO WO 9731783 9/1997

OTHER PUBLICATIONS

Abstract of Japanese Patent Publication No. 60063341, Patent Abstracts of Japan, published Apr. 11, 1985.

* cited by examiner

Roll surface treated with electroplated chromium.("Pretex")

Sheet surface after 10 passes through the Pretex rolls

METHOD AND APPARATUS FOR TEXTURING A METAL SHEET OR STRIP

This invention relates to a method and apparatus for texturing the surface of a metal sheet or strip, particularly, although not exclusively, a sheet or strip formed of an aluminium alloy.

Various methods exist for texturing sheets or strips of metal or paper. However, conventionally, metal sheet texturing is achieved using a rolling mill involving a metal thickness reduction. If a single pass through a set of rolls is made with no metal reduction (as disclosed in WO-A-97/31783 below), then the textured pattern is unsatisfactory with a surface coverage of typically no more than 35%.

In the lithographic field, most lithographic printing is from aluminium plates. These are typically 0.15 to 0.51 mm thick, depending on the size and type of press, although thinner sheets laminated to supports are also used. Aluminium sheet for lithographic plates is generally produced by rolling. This results in a metallurgical structure which is elongated in the rolling direction. The surface of the rolled sheet has marks (roll lines) extending longitudinally, which are not desired in the final grained product, and careful preparation of the rolls is necessary to minimise this effect.

To make an aluminium sheet suitable for use as a lithographic plate support, the surface needs to be roughened, in order to enhance the adhesion of an organic coating on the support, and to improve the water retention properties of the uncoated support surface. Application to the support of a photosensitive layer after anodising, followed by irradiation and development, generally results in a lithographic plate having ink-receptive areas which carry an organic coating, and water-retaining non-image areas, the latter generally being the uncovered support surface. The cost of the graining or roughening step is an important part of the economics of lithographic plate support manufacture.

GB-A-2345881 discloses embossing to achieve a particular topography on the surface of the printing plate substrate. The invention disclosed relates to a purely mechanical roughening process wherein the surface is mechanically roughened with an embossing roller. This is achieved by a single pass through the rollers.

WO-A-95/08408 teaches producing a rough surface on aluminium sheet in a pack rolling process.

WO-A-97/31783 discloses a single roll stand in which one or both of the rolls is textured. The stand is located at the end of a rolling mill and reduces the thickness of a lithosheet by 0-15%.

U.S. Pat. No. 5,857,373 teaches the sequential application of paterns on to a metal surface by at least two work rolls. The patterns on the roll surface are deterministic but are adjusted such that any interference effects between the two are eliminated.

U.S. Pat. No. 4,000,242 discloses the application of multiple embossed patterns to a paper strip as it moves around a large support roll.

U.S. Pat. No. 3,841,963 discloses a vertically oriented stacked roll device for imparting a rough texture to a paper web.

U.S. Pat. No. 6,920,632 discloses the texturing of rolls for rolling sheet, where a rolled sheet or plate is textured by the textured roll. The preferred method is to use either one or both rolls in a single roll set to apply the texture.

EP-A-0273402 discloses an uneven patterned metal strip or plate.

U.S. Pat. No. 5,964,115 discloses a process for applying a defined surface roughness to a steel strip for preventing the sticking of the strip during subsequent annealing. The process includes cold rolling the strip in at least one reversing roll stand.

EP-A-0456162 discloses a method of rolling metal in a plurality of rolling stands with each of the stands having two or more rolls.

There is a need for a texturing process which provides satisfactory coverage of the surface without reducing the sheet thickness. This would avoid distortion and thus the use of expensive flatness control equipment and also allow the use of much simpler and smaller equipment than a rolling mill.

The present invention shows how a satisfactory textured surface may be produced without the use of a rolling mill or without the need for expensive flatness control equipment. The process disclosed herein thus allows for the release of the rolling mill for more productive duty.

According to a first aspect of the present invention, there is provided a method of texturing a metal sheet or strip, which method comprises a plurality of sequential texturing passes each of which is performed by passing the sheet or strip between at least one pair of rollers, wherein at least one of each pair of rollers has a textured pattern on the surface thereof and the textured pattern is transferred to the sheet or strip during each texturing pass, and wherein the textured surface on the sheet or strip resulting from each pass overlaps with that from the one or more other passes to form a final textured pattern.

Thus, the method comprises a surface only texturing transfer process.

Whilst the method could involve a plurality of passes between one pair of rollers, it preferably involves a single pass between a plurality of different pairs of rollers. The rollers may be present in a tandem arrangement.

Preferably, there is substantially no reduction in the thickness of the sheet or strip during each pass. Therefore, the roll pressure is advantageously within the elastic limits of the sheet. In a preferred embodiment, the load applied during each pass is from 20% to 95%, even more preferably 50% to 80% of the load which would cause a measurable thickness reduction in the sheet or strip. Typically, rolling forces per unit width of about 50 N/mm may be used, for example for AA6016 alloys in H19 condition.

In some embodiments, the present invention provides a larger covering of textured surface on the sheet or strip than has previously been achievable with substantially zero metal thickness reduction in a single pass. Preferably, the average area of coverage of the surface of sheet or strip during each pass is less than 35%, even more preferably between 5% and 25% and even more preferably between 10% and 20%.

In a preferred embodiment, three or more texturing passes are used in the method of the invention, for example between five and seven texturing passes. Each texturing pass may produce a different textured pattern on the sheet or strip surface.

A further advantage of the present invention is that the textured pattern produced is more isotropic than patterns generated with thickness reduction. This is because the shearing effect during reduction, which elongates the texture in the rolling direction, is eliminated by the present method. This shearing effect causes local smearing of the metal at the surface which can lead to fine generation or increased surface resistance which can be detrimental on, for example, automotive sheet when spot welding or on lithographic sheet where subsequent electrograining or anodising can be locally impaired.

A further advantage is that the forces used during the texturing are much smaller than those used for conventional metal rolling which means that the support structure of the texturing machine, described in the embodiments below, can be much lighter and cheaper than that for a mill.

It has been found that it is easier to transfer a pattern to a harder rather than a softer sheet. Whilst the applicant is not to be bound hereby, this may be because a higher impressing force can be used before the sheet thickness reduction occurs. Preferably, the texture is applied immediately prior to a solution heat treatment step in a Continuous Annealing Line or surface finishing line. At this location, the metal is still relatively hard and it is also before the final cleaning and rinsing stages. Alternatively, it is possible to texture after solution heat treatment and cleaning.

Any suitable use of the textured metal sheet is envisaged, for example lithographic, automotive, reflector sheet, can body stock or the like.

The method may further comprise the step of graining the sheet or strip before and/or after the texturing step; this is particularly applicable to the embodiment in which the textured metal sheet is used as a lithographic plate.

Thus, according to a further aspect of the present invention, there is provided a method of making a lithographic sheet from an aluminium strip, the method comprising the steps of:

i) texturing the strip to provide a textured microscopic pattern on the surface thereof; and ii) graining the surface of the strip, wherein the graining step is carried out before and/or after the texturing step.

The graining step is preferably carried out after the texturing step. Preferably, graining is from 1% to 80% of that performed on commercial single rolled aluminium sheet. In one embodiment, graining may be carried out by electrograining, for example in a nitric acid or hydrochloric acid based electrolyte.

Any appropriate method of texturing known to those skilled in the art can be used. Examples are described in GB-A-2345881 and WO-A-97/31783, which are incorporated herein by reference. The texturing may provide a pattern of coarse pits to produce a uniform non-directional surface with a specified $R_a$ and $R_z$.

Specification of surface parameters in terms of $R_a$ and $R_z$ are well known to those skilled in the art. In the present work, the parameters were measured by means of optical interferometry using Wyko (Trade Mark) equipment.

The graining is preferably electrograining. Any electrograining method is appropriate, and the electrograining may take place in nitric or hydrochloric acid.

The graining produces a structure in the aluminium sheet having fine pits, which gives good printing results in the lithographic plate support.

Preferably, the graining is short relative to that performed on commercial single rolled aluminium sheet, that is the graining is shorter compared with that carried out on an equivalent single rolled aluminium sheet of a composition within the same Aluminium Association designation. This provides significant economic advantages resulting from the reduction in the time and energy used for graining. Typically, the graining may be from 1% to 80% of that performed on commercial single rolled aluminium sheet, for example 20 to 70% more typically less than 50%.

The amount of electrograining can be expressed in terms of the charge densities required to produce a satisfactory surface. Normal commercial nitric and hydrochloric acid graining requires charge densities of about 90-100 $kC/m^2$. Other electrolytes may need different charge densities. For example electrolytes based on $HNO_3$ with boric acid may grain more slowly and require higher charge densities whilst others using additions of acetic acid may be about the same as the conventional hydrochloric acid. In recognition of these differences, the charge density is probably best expressed as a percentage of that required in the corresponding electrolyte with as rolled material.

This reduction in graining represents a significant saving in graining time, chemicals, power and waste materials to be disposed of.

The term aluminium is herein used to cover the pure metal and alloys in which aluminium is the major component. Any appropriate alloys could be used, but examples are those in the AA1000 (for example AA1050A) or AA3000 (for example AA3103) or AA6000 (for example AA6016A) or AA5000 (for example AA5182 or AA5754) series of the Aluminium Association Register. Nevertheless, a wider range of alloys can be used.

In a preferred embodiment, the total length of the strip is increased by between 0 and 0.5%, preferably less than 0.2%, during texturing. Preferably, the total length of the strip is not increased during texturing (i.e. 0% elongation).

A plurality of texturing operations are preferably performed, for example by a single pass of the strip through a plurality of successive pairs of rollers, at least one of each pair having a textured microscopic pattern on the surface thereof to provide texturing to the aluminium sheet. In each embodiment of the invention, the texturing preferably produces a uniform, non-directional surface of coarse pits on the surface of the strip.

According to a further aspect of the present invention, there is provided a method of making a lithographic sheet, which method comprises texturing an aluminium strip to provide a textured microscopic pattern on the surface thereof by a plurality of texturing operations.

According to a further aspect of the present invention, there is provided an automotive sheet or strip formed by the method of the invention.

According to a further aspect of the present invention, there is provided a lithographic sheet or strip formed by the method including the graining step.

In one embodiment, particularly for automotive sheet, the objective of the invention is to apply the texturing off-line of the rolling process, releasing the rolling mill for work more suited to its design.

According to a further aspect of the present invention, there is provided an apparatus for texturing a metal sheet or strip, the apparatus comprising:

(a) at least one pair of rollers, wherein at least one of each pair of rollers has a textured pattern on the surface thereof;

(b) means for providing a plurality of sequential texturing passes, wherein, in use, the textured pattern is transferred to the surface of a sheet or strip passing between each pair of rollers and the textured pattern on the sheet or strip resulting from each pass overlaps with that from the one or more other passes to form a final textured pattern.

Preferably, the apparatus comprises a plurality of pairs of rollers, and each pair of rollers may be situated in a separate station. The rollers are preferably present in a tandem arrangement.

The apparatus may further comprise means for applying pressure to the rollers, wherein the pressure applied is such that there is substantially no reduction in the thickness of the sheet or strip during each pass.

The rollers are preferably capable of providing an average area of coverage of the surface of sheet or strip, in use, of less than 35%, preferably between 5 and 25%, even more preferably between 10 and 20%.

The apparatus may comprise means for providing three or more texturing passes, preferably between five and seven texturing passes, for example in separate stations.

In a preferred embodiment at least one of each pair of rollers has a textured pattern thereon which is different from the textured pattern on at least one of each of the other pairs of rollers.

According to a further aspect of the present invention, there is provided a method of making a lithographic sheet, which method comprises texturing an aluminium sheet or strip to provide a textured microscopic pattern on the surface thereof by a plurality of texturing operations.

According to a further aspect of the present invention, there is provided a method of making a lithographic plate comprising texturing an aluminium sheet or strip to provide a textured microscopic pattern on the surface thereof by a plurality of texturing operations, optionally subtractive graining and anodising or optionally additive graining, optionally treating with a surface free energy modifier and coating with a light sensitive layer.

The plurality of texturing passes or operations has been found to produce a uniform finish. Thus, the invention utilises a succession of "passes" each of which produce partial texturing to achieve an acceptably comprehensive texturing yet preferably without significant length increase and its consequent problem of off-flatness. Therefore, each texturing operation preferably results in little or no increase in length (or alternatively reduction in the thickness) of the aluminium strip. It has been found that there is then no requirement to control strip flatness, which is advantageous.

As mentioned above, the texturing may be carried out by means of a plurality of passes between a single pair of rollers or by means of one or more passes between a plurality of pairs of rollers, wherein at least one of each of the one or more pairs of rollers has a textured microscopic pattern on the surface thereof.

Preferably, texturing is carried out downstream of the rolling mill, and may be done by means of pinch rolls, before or during levelling. In all relevant aspects of this invention, it is preferred that texturing is carried out before any cleaning step which, in turn, is preferably carried out before any graining step which may be present.

The rollers may be obtained using a variety of texturing methods, for example electro-discharge (EDT), electron beam (EBT), laser beam treatment (Lasertex), or electrochrome deposition (ECD). EDT and ECD are preferred as these give randomly distributed surface features. The roll surface preferably has a positively skewed texture i.e. $R_{sk}$ is positive.

The aluminium strip may be textured on only one side, or on both sides as required. The texturing rollers may be formed, for example, from steel or a polymer, and may be lubricated. An example of a suitable lubricant is a mixture of water and isopropanol, a rust inhibitor may be present.

Throughout the various aspects of this invention, where graining is present, two types of graining are envisaged. The sheet may be etched in a chemical reagent that removes some metal from the surface by forming pits of a preferred size. This is referred to herein as subtractive graining and may be performed either before or after texturing. It is probably more practical to carry out subtractive graining after texturing. Alternatively, an organic or inorganic layer may be applied to the textured surface. This is referred to herein as additive graining. In one embodiment, this layer may comprise a Type A sol which is itself derived from an inorganic precursor. The layer may be hydrophilic, in which case it may be formed by contacting the strip with a liquid comprising a silicate solution in which particulate material is dispersed. Additive graining may give a more isotropic surface that aids adhesion of the image coating to the substrate. Clear or pigmented additive coatings may be applied and these may also aid the visual appearance of the final product. The processes described in WO-A-91/12140 and WO-A-97/19819 (incorporated herein by reference) are examples of additive graining. Graining, as used herein, includes either of these processes. Thus, for example, in additive graining, where an organic or inorganic layer is applied to the surface, the layer may comprise a Type A sol which is itself derived from an inorganic precursor. The layer may, in one embodiment, be hydrophilic and may be formed by contacting the strip with a liquid comprising a silicate solution in which particulate material is dispersed.

For the applications in which graining is not present, a less directional finish would have advantages from a cosmetic viewpoint, for example allow the printer (in a lithographic use) to examine the surface without the directionality distracting him. Two types of plate may be important here. The Toray type employs two layers of material, one hydrophilic and the other hydrophobic. Ablating off the top layer by laser allows the differential printing characteristics to be obtained.

In one embodiment, the size and/or pattern of each texturing operation or pass may be different from other texturing operations or passes. For example, the first texturing operation could impress a relatively large pit, say up to about 50 microns, preferably 20 microns, and the subsequent operations could impose smaller ones, down to about 3 microns. Alternatively, the large pits could be imposed after the smaller ones or the sequence rolls could be arranged to impose the pits in any particularly advantageous order.

According to a further aspect of the invention, there is provided an apparatus for making a lithographic sheet, the apparatus comprising:

i) a plurality of first rollers arranged such that an aluminium strip is capable of passing between adjacent pairs of the rollers; and ii) one or more guiding means to guide the strip into and/or from the first rollers, wherein at least one of the rollers has a textured microscopic pattern on the surface thereof which is adapted to texture the aluminium strip.

Preferably, more than two first rollers are present. They are preferably arranged adjacent one another, for example in a substantially linear arrangement. In one embodiment, all of the first rollers may have a textured microscopic pattern on the surface thereof. This provides texturing to both sides of the strip. If it is desired to apply texturing to one side of the strip only, then an alternative embodiment could be provided wherein alternate first rollers have a textured microscopic pattern on the surface thereof.

Preferably, the guiding means is in the form of one or more second rollers.

The first rollers may be heated in a controlled manner so that the thermal camber compensates for any deflection of the rollers under the applied load and so that the overall temperature of the first roller arrangements could be raised or lowered to adjust the efficiency of texturing. Such heating may be in place of or additional to any ground camber that may conventionally be applied to rolls.

Each of the first rollers may have the same or a different pattern thereon.

The invention will now be described, by way of example only, with reference to the following drawings, and in which.

Figure 7:
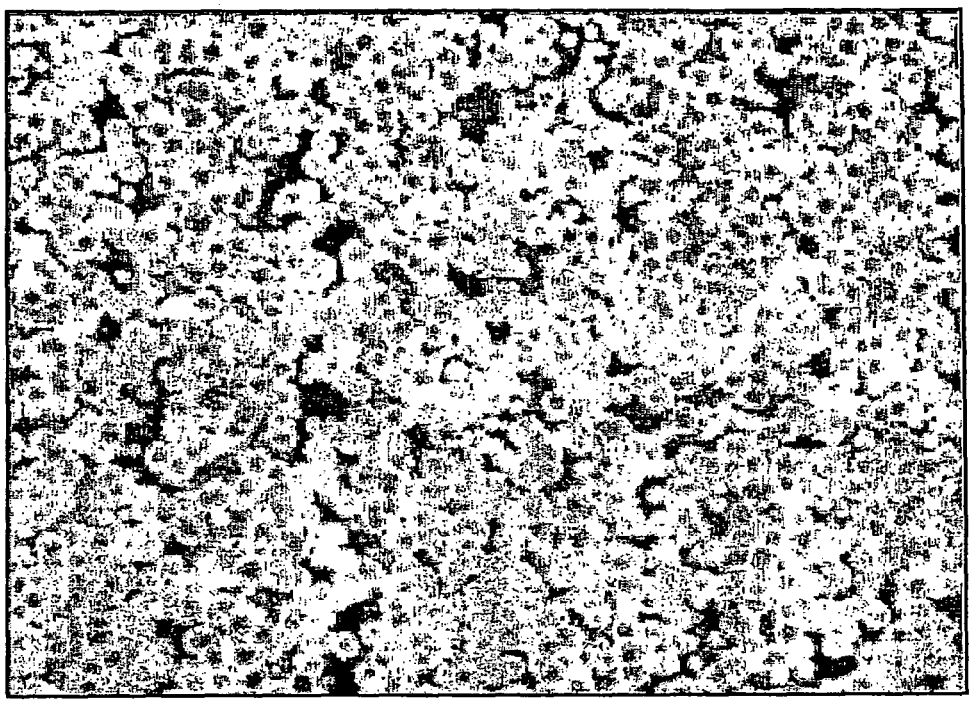

FIGS. 6A-H shows the surface of a metal strip after a varying number of passes;

FIG. 7 shows a roll surface treated with a Pretex process; and

Figure 8:
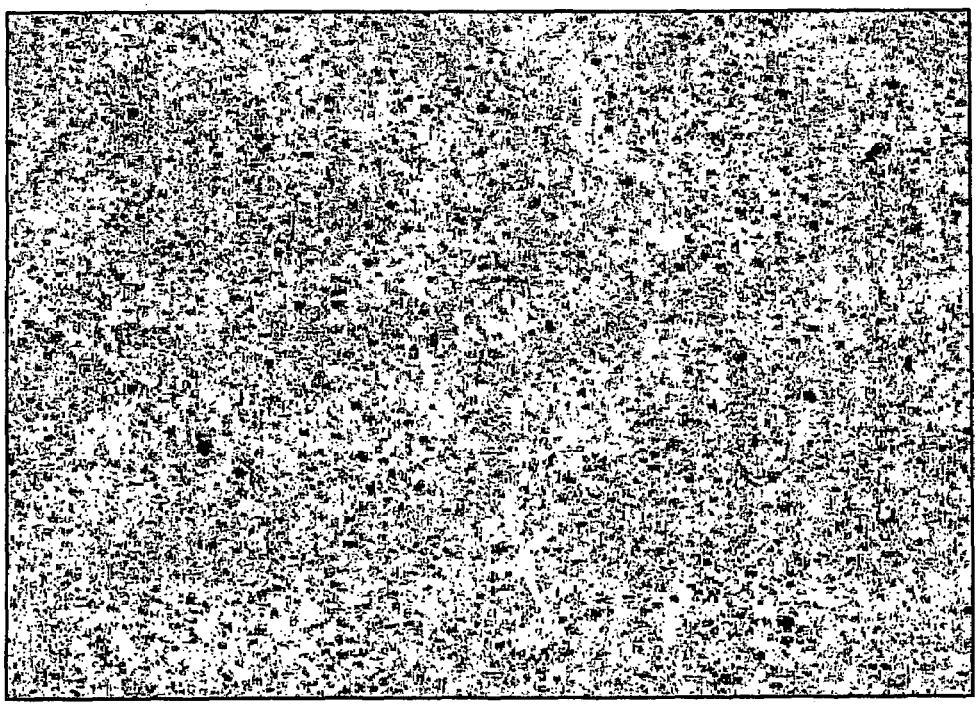

FIG. 8 shows the surface of an alloy strip after 10 passes.

Figure 1:
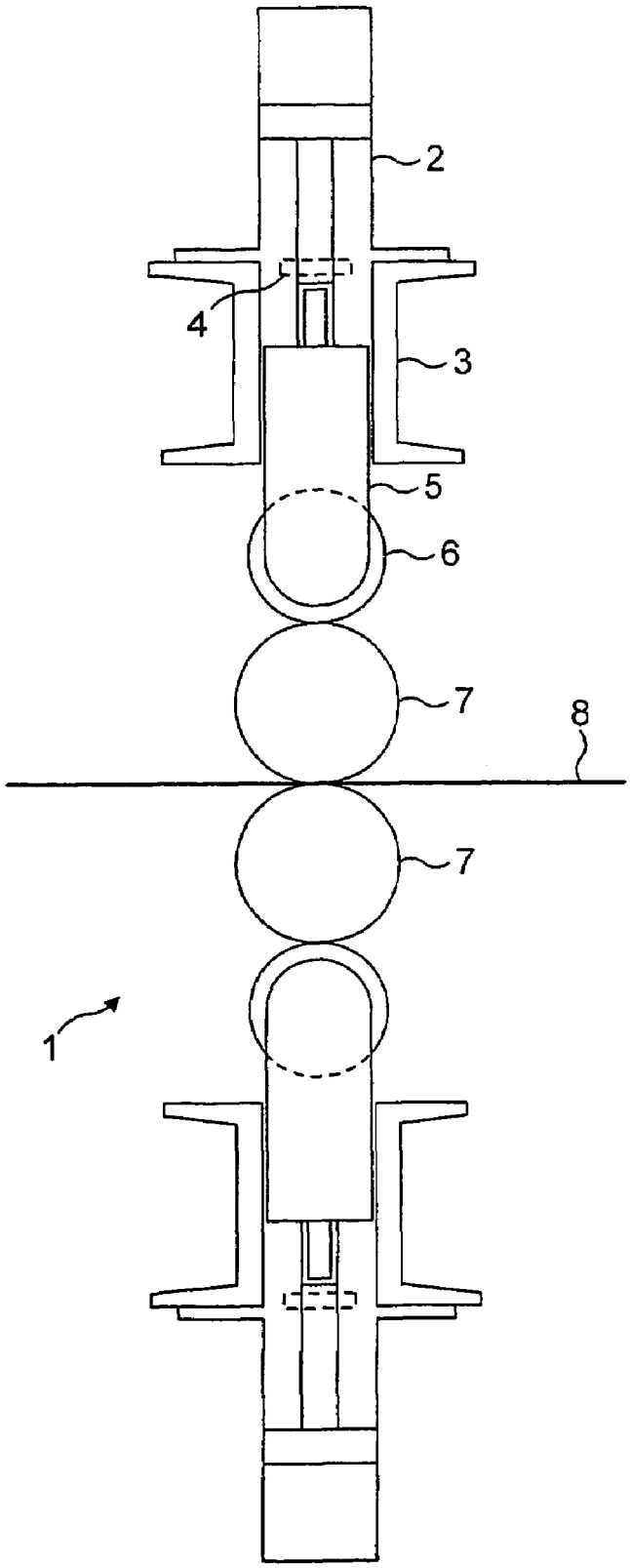
FIG. 1 is a schematic cross-section view of a single stand of an apparatus according to the present invention.

Referring to FIG. 1, there is shown a single stand of the present invention generally at 1. The stand 1 comprises a hydraulic cylinder 2 positioned adjacent to a beam 3. A lateral alignment linkage 4 is positioned within cylinder 2 and serves to provide lateral alignment for rolls in the stand 1. Longitudinal support is provided by support 5.

In the embodiment shown, two sets of rollers are present. These include hard polyurethane covered support roll 6, which is present to avoid damage to textured roll 7. The roll 7 typically has a diameter of 100-150 mm, for example 100 mm. In an alternative embodiment, the roll 6 may be replaced by two (or more) similar rolls which are offset, but each contact roll 7 and provide lateral stability thereto. The textured roll 7 can be formed by any suitable method, for example Electron Discharge Texturing (EDT), which is known in the art.

In FIG. 1, an identical arrangement showing components 2 to 7 is illustrated in the bottom half of the stand and is arranged so that rolls 7 are adjacent one another.

In use, a metal sheet 8 is passed between rolls 7 which thereby transfer texturing to the surface of sheet 8. The hydraulic cylinder acts to adjust the load on sheet 8 such that the thickness reduction is negligible, and typical rolling loads are about 50 N/mm (10 tonnes load for a 2 m wide strip).

Figure 2:
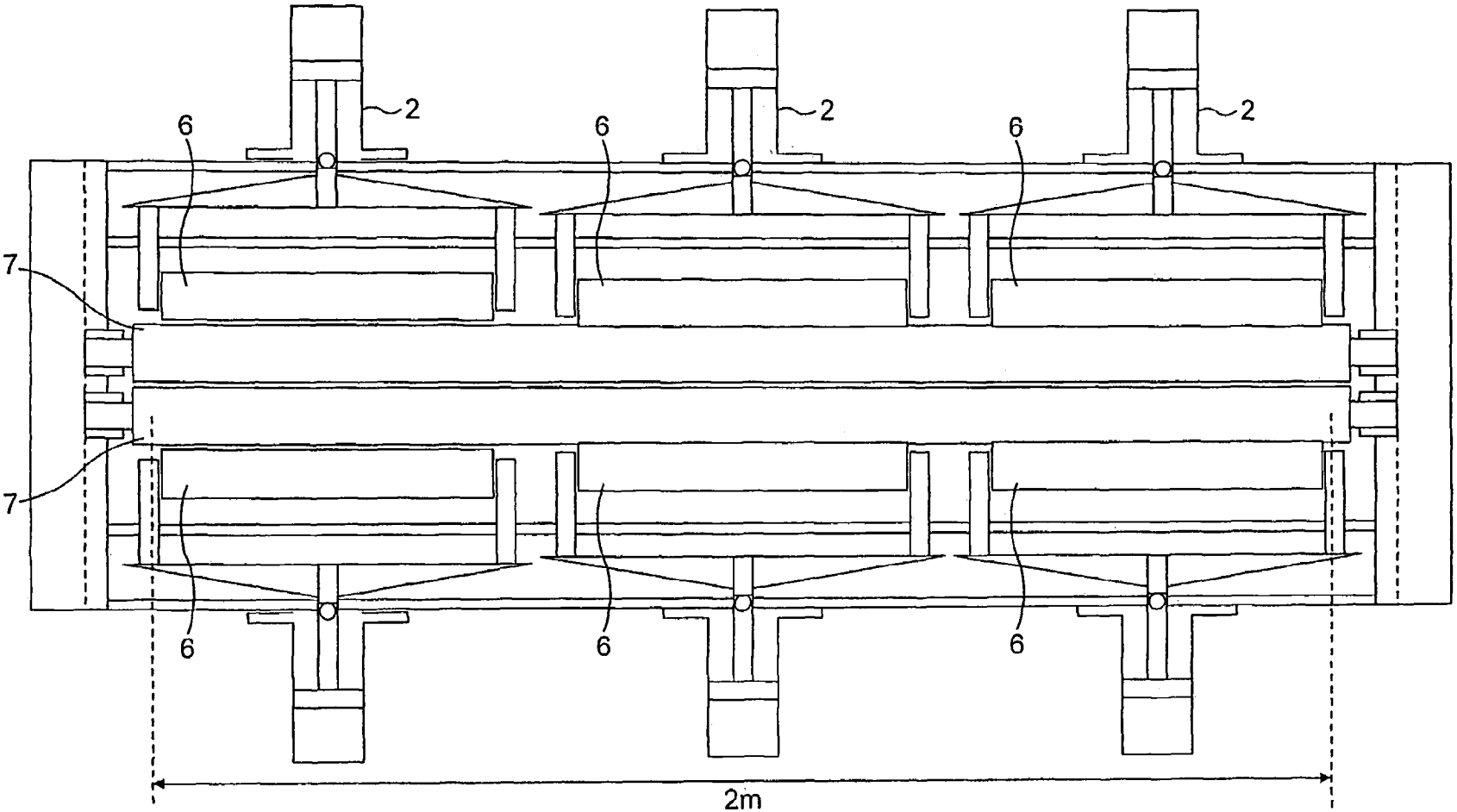
FIG. 2 is a schematic front view of the stand of FIG. 1.

FIG. 2 shows a front view of the stand of FIG. 1. Shown are two sets of three rolls 6, each contacting a textured roll 7, although more or fewer rolls 6 could be used as necessary.

Figure 3:
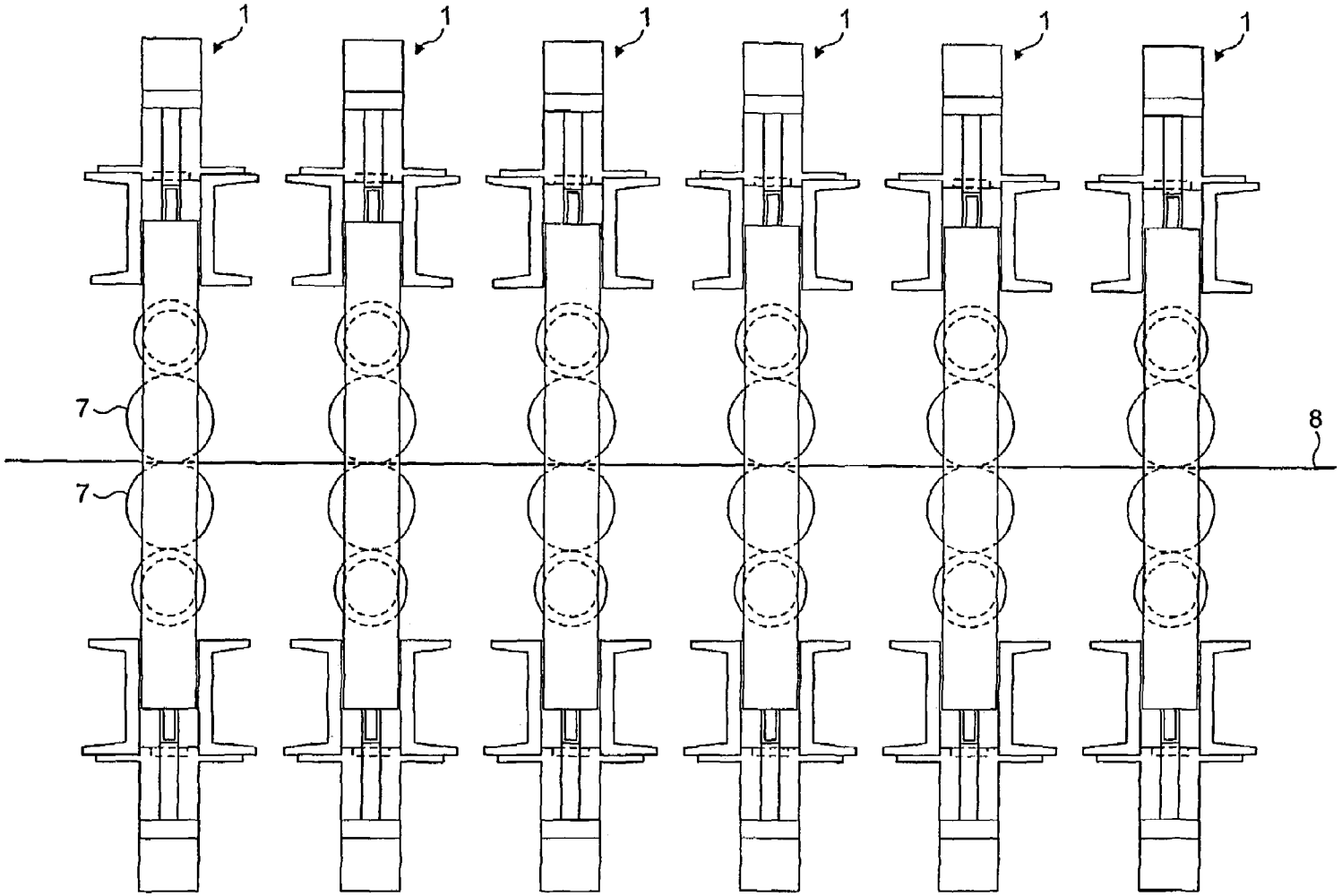
FIG. 3 is a schematic cross-section view of multiple stands.

FIG. 3 shows six stands 1 which are adjacent to one another and are fixed together in order to provide torsional stability. In this way, stands 1 are in tandem in order to provide the required level of texturing. In use, sheet 8 passes between rolls 7 of each stand in succession and thereby a textured surface is gradually built up on sheet 8 through the individual application of multiple, partial patterns that overlap each other. In this way, the texture is built up and high rolling pressures that would otherwise permanently distort the sheet surface are avoided.

Figure 4:
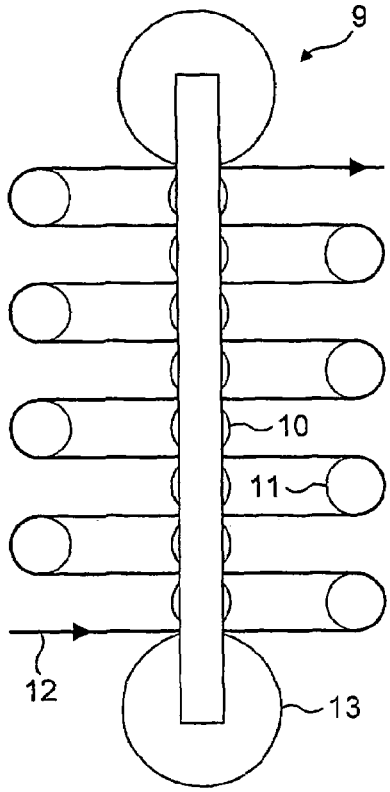
FIG. 4 is a schematic drawing illustrating part of an alternative apparatus in accordance with the invention.

FIG. 4 illustrates part of an alternative apparatus which can be used in the part of the process in which an aluminium strip is textured. The apparatus is shown generally at 9. Apparatus 9 comprises a plurality of work rolls 10 and guiding idler rolls 11 which are preferably soft. In the embodiment illustrated, the work rolls are formed from steel and are arranged in a stacked arrangement whereby they are clamped together under a controlled force. The rolls 10 are textured as required to texture an aluminium strip 12 when the apparatus is in use. The rolls 10 do not necessarily have the same texture. In use the aluminium strip 12 is fed into the apparatus 9 at the lower end thereof. The work rolls 10 are driven using mechanically or electrically linked drives. As the strip 12 progresses through the apparatus 9, it is guided by means of rolls 11 and passes between the rolls 10 as shown. The diameter of the rolls 11 is chosen to avoid stretching of the strip 12, or alternatively to deliberately stretch the strip if further levelling of the strip is desirable. The work rolls 10 are heated in a controlled manner.

As the strip 12 passes between rollers 10, it is textured and undergoes a succession of texturing passes, each of which produces a negligible or no material thickness reduction in (or elongation of) the strip 12. In the embodiment shown, a textured surface is applied to both sides of strip 12. However, if it were desirable to texture one side only, then the arrangement of the rolls 10 may be altered such that they are of two types which are alternated in the stack. For example, the first would be a textured steel roll, the second a soft, smooth (for example polyurethane) coated roll, the third another steel roll, and so on. In this way, the soft smooth polyurethane coating would not alter the surface of the strip on one side while the steel rolls would texture the other side of the strip 12. This has particular benefits for lithographic products, where the directionality of the as-rolled strip surface is a disadvantage, but a uniform surface is usually only required on one side.

Different textures on the two sides of the strip 12 can be achieved by alternately stacking rolls 10 of different texture.

The apparatus is compact and gives controlled texturing on each pass.

If desired the textured strip 12 may be grained subsequently either by additive graining or by subtractive graining such as electrograining.

Also shown in FIG. 4 are shown optional backup rolls 13 which are preferably textured. These allow the possibility of stiffening the roll stack and reducing stack deflection under texturing load. The rolls 13 do not come into direct contact with rolls 10, which avoids the wear of the textured working surface. If necessary the thermal control could be applied to rolls 13 which, because of their larger diameter would give a larger dimensional effect for a given temperature difference.

EXAMPLE 1

The following texturing processes were carried out on an AA6016 alloy, which is a heat treatable aluminium magnesium silicon alloy:

TABLE 1

| Run no. | Number of passes | Rolling forces (kN) (Sample width, 150 mm) | Measured elongation after final pass % | Area fraction of Mill finish remaining after final pass % |
|---|---|---|---|---|
| 1 | 1 | 7.18 | −0.014 | 92 |
| 2 | 2 | 7.06, 6.83 | −0.08 | 87 |
| 3 | 3 | 7.18, 7.10, 6.97 | −0.011 | 77 |
| 4 | 4 | 6.73, 6.94, 6.93, 7.07 | 0.046 | 72 |
| 5 | 5 | 7.47, 7.37, 7.31, 7.36, 7.44 | 0.062 | 55 |

Figure 5:
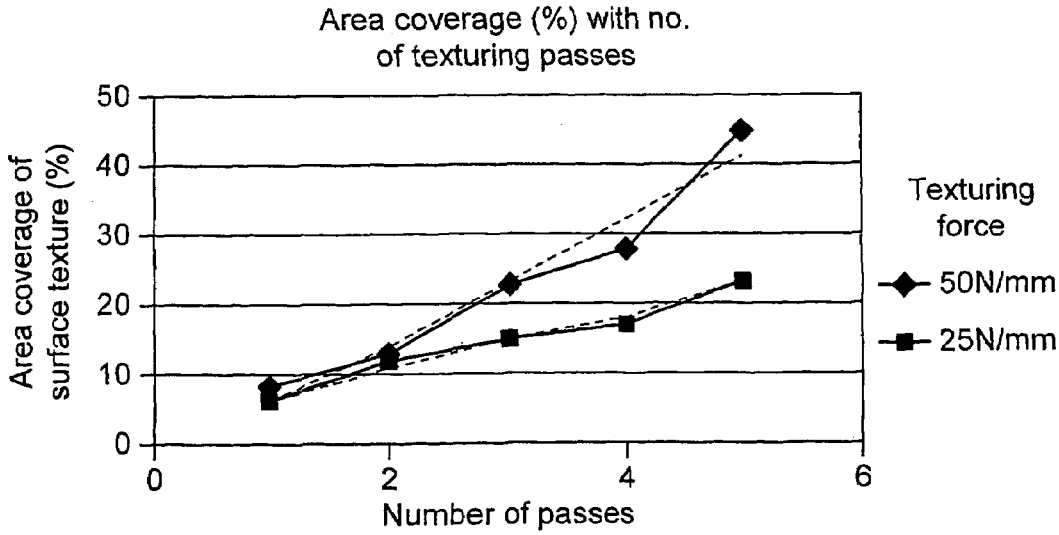
FIG. 5 is a graph showing area coverage of a metal strip against the number of passes according to the invention.
Figure 6:
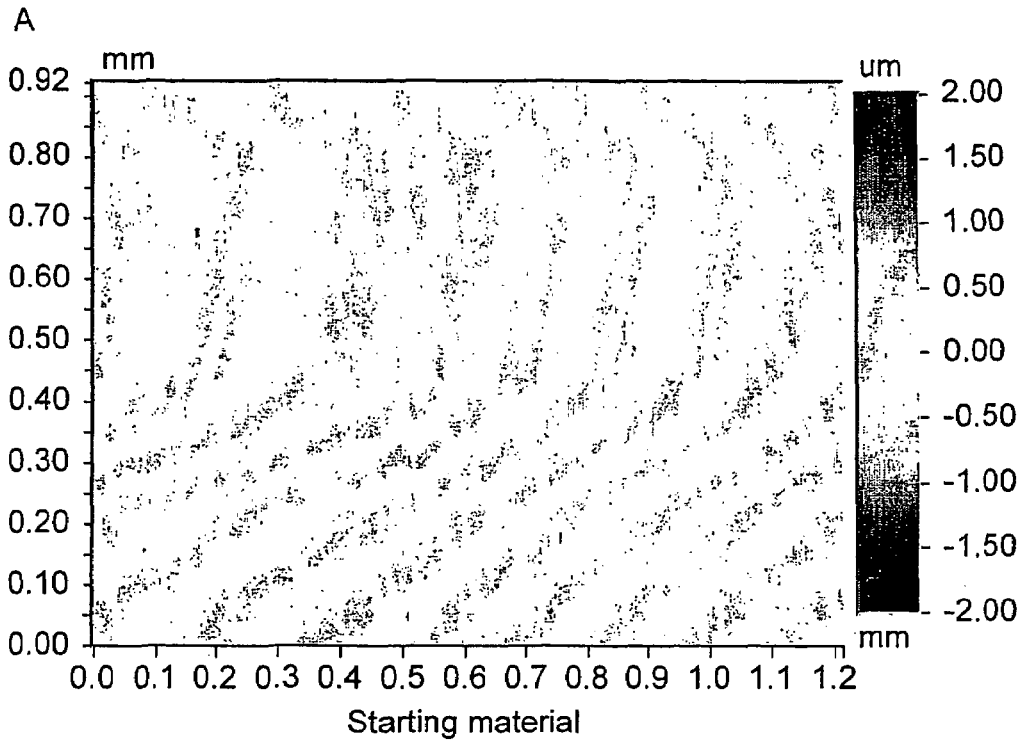
Figure 6:
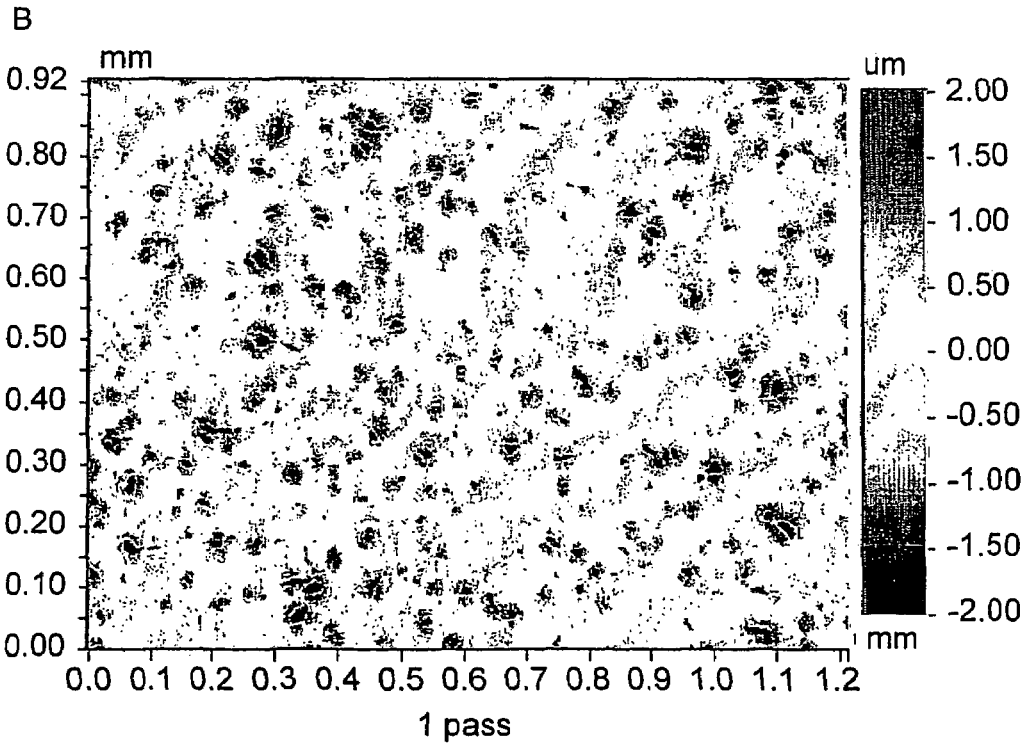
Figure 6:
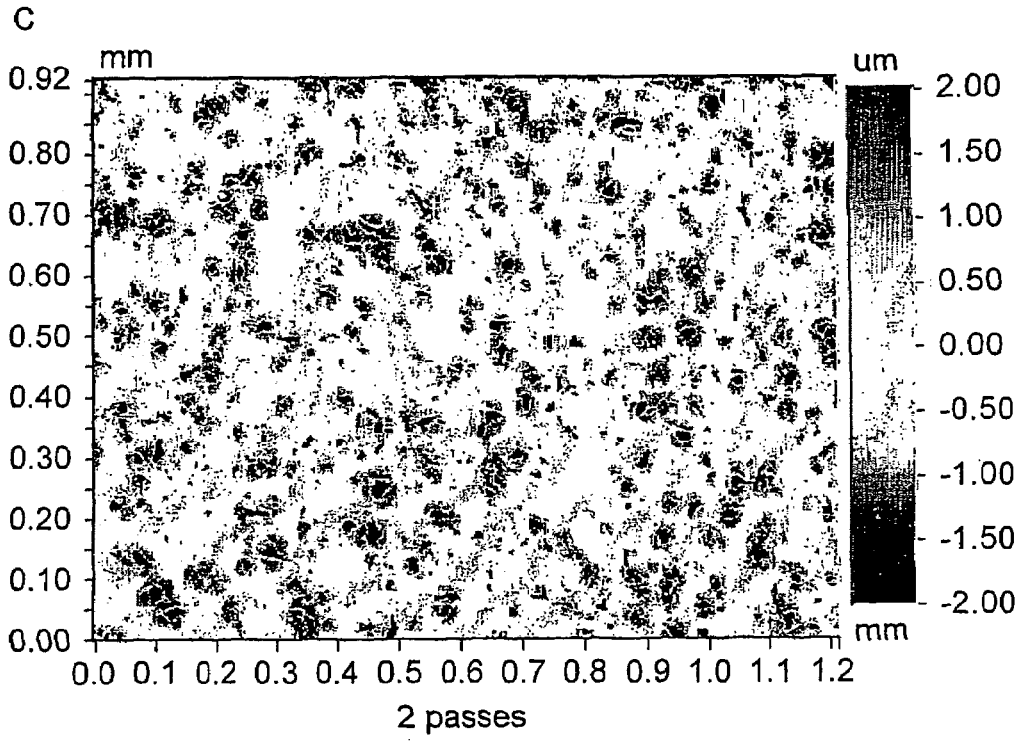
Figure 6:
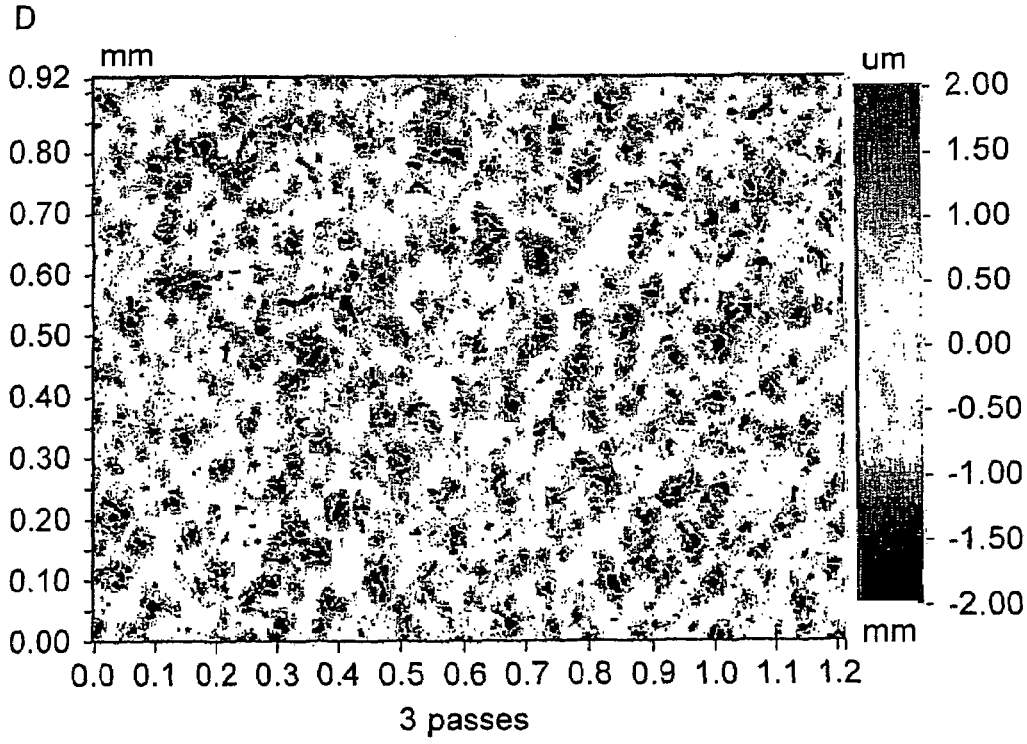
Figure 6:
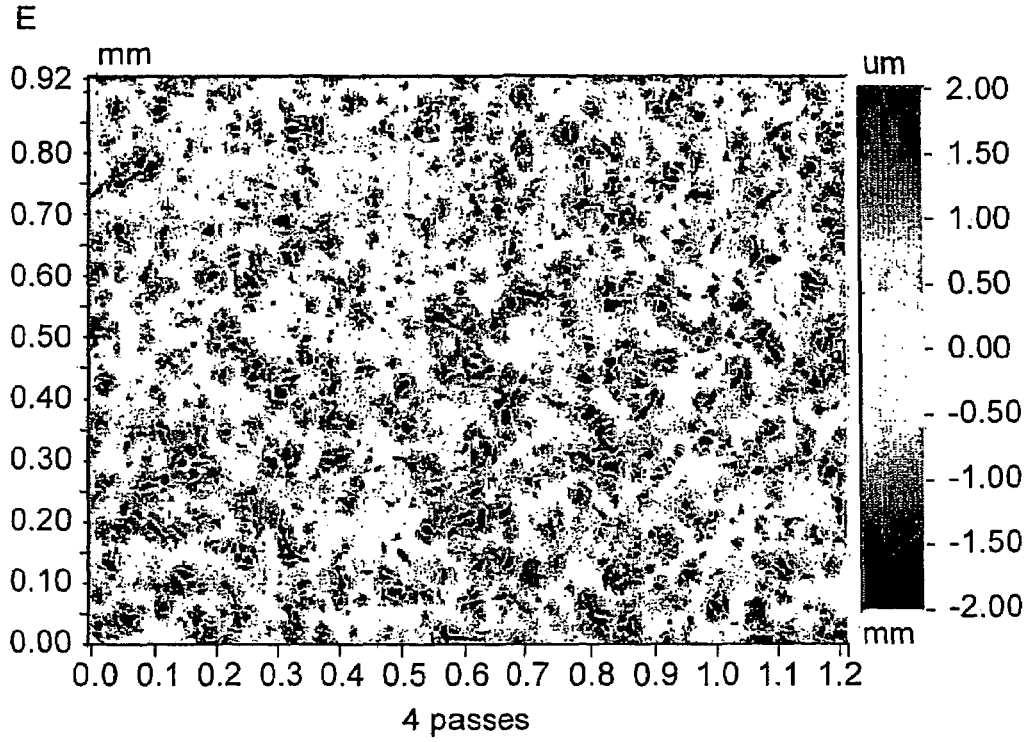
Figure 6:
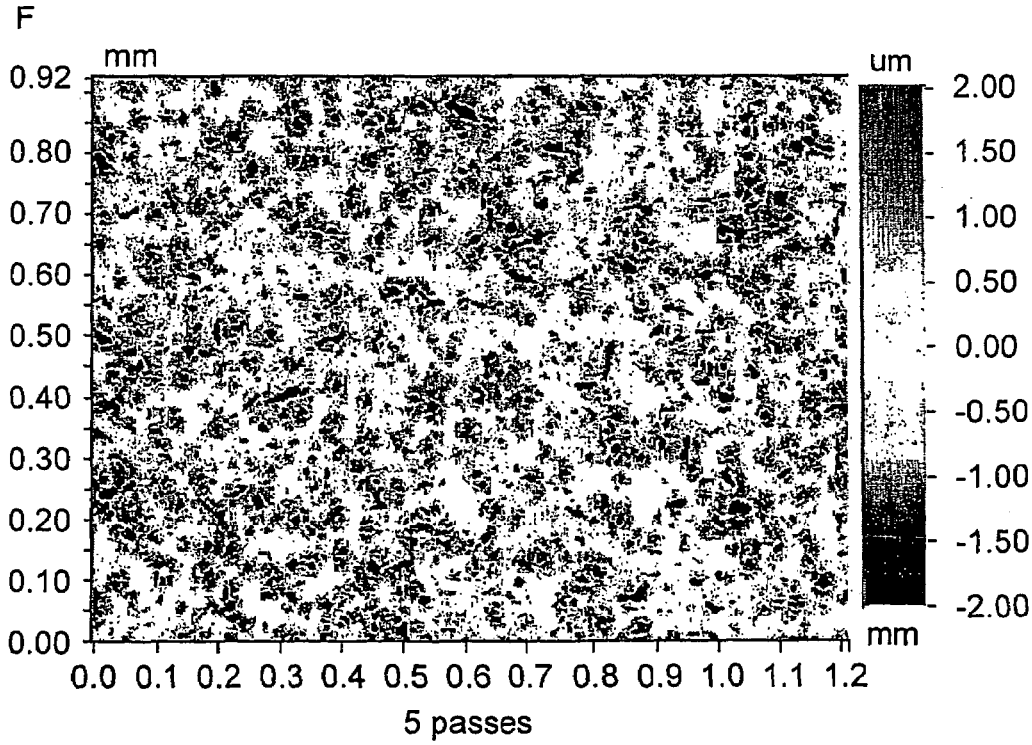
Figure 6:
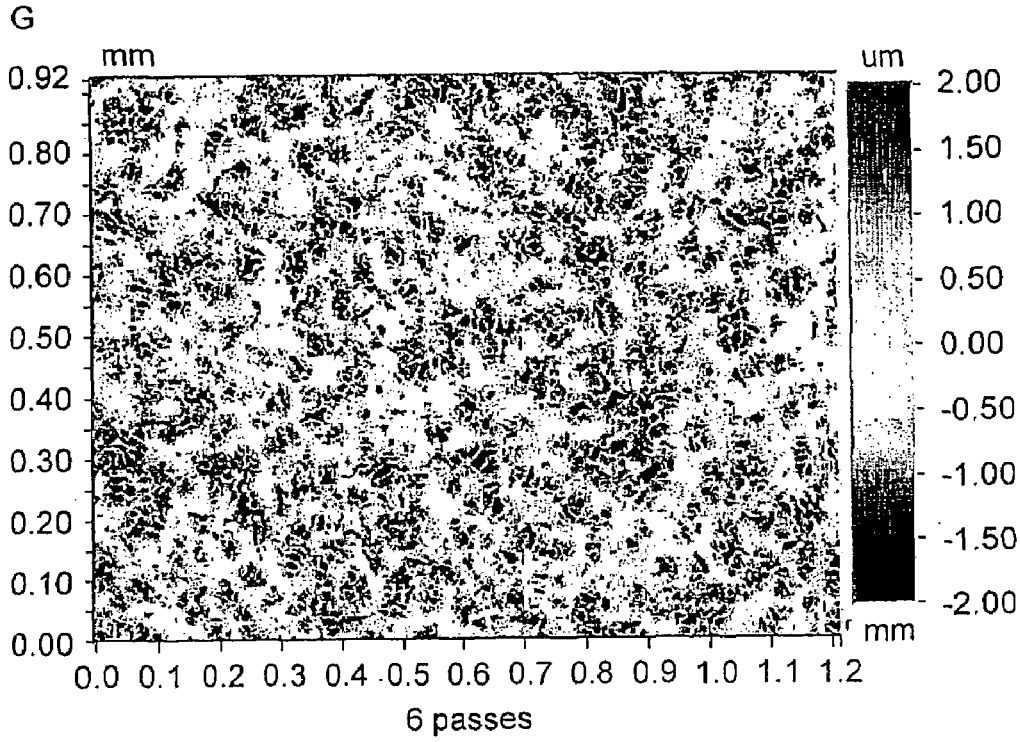
Figure 6:
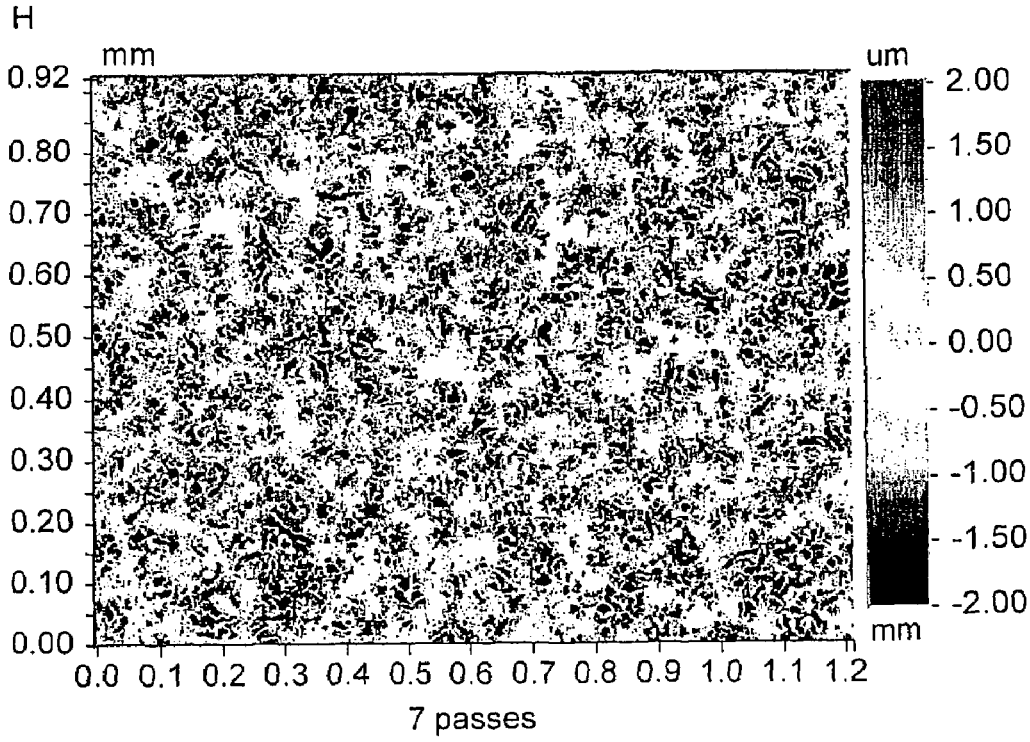

The measured elongations were all smaller than the measurement error and so were essentially zero. In Table 1% elongation was used as a measure of metal thickness reduction. The rolling forces per unit width were about 50 N/mm. The results are shown in FIG. 5, together with those for a texturing force of 25 N/mm.

EXAMPLE 2

FIGS. 6A-H shows how the textured pattern is built up over seven passes through the mill, according to the present invention. The material is AA6016 in H19 condition and, again, the force used to produce the pattern was 50 N/mm width which, as mentioned above, is small enough to produce negligible thickness reduction. It can be seen that there is a good degree of isotropy in the surface texture after five or six passes. It has been found that the degree of surface coverage is higher for texturing rolls with higher surface feature peak count and a higher skew value (see definition of skew below).

Table 2 below shows the measurement of surface characteristics after each pass using parameters which are defined as follows:

Reference mean line=The mean line is a straight line which runs centrally though the peaks and valleys, dividing the profile so as to enclose equal areas above and below the line. The reference mean surface is the three-dimensional reference surface about which the topographic deviations are measured.

Rt=Vertical distance between the highest peak and the lowest valley of the entire 3D surface (same of P−V).

Rsk=Skewness (a measure of the asymmetry around the mean line) of the 3D surface. Skewness is a measure of the asymmetry of the profile about the mean line. Similar to a mean cubed roughness. Points that are far away from the mean surface have proportionately more weight than those closer to the mean surface level.

Rku=Kurtosis of the 3D surface. Kurtosis is a measure of the peakedness of the profile above the mean line. It provides information about the 'spikiness' of a surface, or the sharpness of the amplitude density function (ADF), which does, not necessarily mean the sharpness of individual peaks. The Kurtosis value is high when a high proportion of the profile heights fall within a narrow range of heights. Kurtosis is also a measure of the randomness of profile heights. A perfect Gaussian or random surface will have a Kurtosis of 3, the further the value is from 3, the less random (or more repetitive) the surface. Profiles with fewer high and low extreme points than a Gaussian surface have a Kurtosis value less than 3; those with an appreciable number of high and low extremes have a Kurtosis value greater than 3.

Surface area index=Comparison of the (2D) lateral surface area and the (3D) surface area of the sample.

Volume=Estimates the volume occupied by the space between a surface and a plane parallel to the reference plane of the surface that intersects the maximum height(s) of the surface.

TABLE 2

6016 H19 Tandem Texturing Samples (Without Lubricant) - 3D Roughness Measurements - Amplitude Parameters (Raw Data)
1.20 mm × 0.92 mm area (1.65 μm sampling)
All data is an average of four measurements with the terms tilt and cylinder removed
Sample width - 100 mm

| Number of Mill Passes | Average Load (kN) | Average Speed (m/min) | Statistic | Ra (μm) | Rq (μm) | Rz (μm) | Rt (μm) | Rsk | Rku | Surface Area Index | Volume (μm^3) × 10^5 |
|---|---|---|---|---|---|---|---|---|---|---|---|
| 0 | n/a | n/a | average | 0.15 | 0.19 | 2.61 | 3.73 | −0.08 | 6.31 | 1.0038 | 4.13 |
| | | | std.dev | 0.02 | 0.03 | 0.95 | 0.75 | 0.83 | 6.34 | 0.0005 | 0.59 |
| 1 | 4.82 | 25.53 | average | 0.34 | 0.64 | 11.80 | 15.21 | −2.93 | 28.19 | 1.0219 | 13.09 |
| | | | std.dev | 0.03 | 0.05 | 0.16 | 1.83 | 0.20 | 3.98 | 0.0027 | 1.51 |
| 2 | 5.19 | 25.81 | average | 0.55 | 0.92 | 14.13 | 19.14 | −2.25 | 15.74 | 1.0437 | 17.38 |
| | | | std.dev | 0.01 | 0.02 | 0.62 | 3.65 | 0.06 | 0.42 | 0.0018 | 0.15 |
| 3 | 4.24 | 25.02 | average | 0.64 | 1.04 | 14.18 | 18.26 | −2.10 | 13.28 | 1.0555 | 18.38 |
| | | | std.dev | 0.03 | 0.03 | 1.11 | 2.87 | 0.20 | 1.82 | 0.00335 | 1.69 |
| 4 | 4.20 | 25.41 | average | 0.71 | 1.12 | 14.30 | 15.86 | −1.91 | 11.13 | 1.0654 | 19.89 |
| | | | std.dev | 0.01 | 0.02 | 1.80 | 2.83 | 0.16 | 1.50 | 0.0017 | 1.27 |
| 5 | 4.27 | 25.08 | average | 0.83 | 1.26 | 15.42 | 21.19 | −1.67 | 9.05 | 1.0808 | 21.92 |
| | | | std.dev | 0.04 | 0.06 | 0.40 | 3.58 | 0.11 | 0.45 | 0.0042 | 0.84 |
| 6 | 4.35 | 25.13 | average | 0.94 | 1.37 | 17.93 | 24.53 | −1.53 | 7.97 | 1.0964 | 23.49 |
| | | | std.dev | 0.03 | 0.05 | 2.19 | 3.49 | 0.11 | 0.65 | 0.0068 | 1.01 |
| 7 | 4.33 | 25.54 | average | 1.05 | 1.48 | 17.45 | 21.46 | −1.44 | 7.00 | 1.1129 | 23.95 |
| | | | std.dev | 0.05 | 0.06 | 0.97 | 1.19 | 0.07 | 0.57 | 0.0047 | 1.03 |
| 8 | 4.37 | 27.06 | average | 1.12 | 1.55 | 18.04 | 24.99 | −1.36 | 6.63 | 1.12203 | 25.01 |
| | | | std.dev | 0.04 | 0.04 | 1.04 | 2.87 | 0.07 | 0.39 | 0.0026 | 0.94 |
| 9 | 4.20 | 23.49 | average | 1.16 | 1.59 | 17.38 | 23.33 | −1.33 | 6.30 | 1.1282 | 25.47 |
| | | | std.dev | 0.02 | 0.02 | 0.63 | 3.02 | 0.09 | 0.54 | 0.0019 | 1.45 |
| 10 | 4.88 | 23.95 | average | 1.27 | 1.70 | 21.21 | 26.28 | −1.21 | 5.77 | 1.14254 | 26.08 |
| | | | std.dev | 0.05 | 0.05 | 3.73 | 5.82 | 0.03 | 0.21 | 0.0068 | 0.92 |

Ra=Arithmetic average roughness height over the entire 3D surface. Measured about the mean line or surface.

Rq=RMS average roughness height over the entire 3D surface (same as RMS).

Rz=Difference between the average of the highest peaks and lowest valleys of the entire 3D surface.

EXAMPLE 3

Rolling was carried out on a single stand cold rolling mill provided with 157 mm diameter ETD roughened steel work rolls wherein the surface roughness was $R_a$ 2.5 microns and $R_{sk}$ was zero. The mill gap was set to provide a very small elongation per pass. A 0.27 mm thick, 75 mm wide strip of AA1050A alloy in the H19 condition was repeatedly passed through the mill. Samples taken after an appropriate number of passes were examined by optical interferometry in a Wyko instrument NT 2000 and the surface characteristics noted.

The measurements were carried out in vertical scanning interferometry mode (VSI). The objective lens used was 10.2× magnification and field of view of 0.5× resulting in an examination area of 1.2 mm×0.92 mm.

The percentage mill finish remaining was calculated using the histogram data. The points in the histogram that originated from the pits on the surface were chopped out and the remaining points, which were attributed to the mill finish, were calculated as a percentage of the total number of data points present in the image.

The elongation was calculated by re-measuring the parallel lines scribed on the sample using a camera head attached to a co-ordinate measuring machine.

Table 3 lists the results obtained on material examined in the as rolled condition.

TABLE 3

Textured Samples

| Run | No Passes | Strain % | Av. Load kN/mm | $R_a$ Microns | Mill finish Remaining % |
|---|---|---|---|---|---|
| 1 | 1 | 0.01 | .031 | 0.29 | 94 |
| 2 | 3 | 0 | .023 | 0.30 | 93 |
| 3 | 6 | 0.06 | .026 | 0.47 | 84 |
| 4 | 10 | 0.08 | .025 | 0.59 | 70 |

Part of each textured sample was cleaned and subjected to electrograining in a nitric acid electrolyte under conditions that mimic those used in commercial production. Samples were cleaned in a 3% sodium hydroxide solution held at 60° C. for 8 s. After rinsing, they were then mounted in a microcell system that had been set up to simulate a commercial finish. The samples were electrograined in a 1% wt/wt hydrochloric acid solution at 35° C. for 15 or 30 s. Thirty seconds is the normal time taken to complete graining for standard H18 AA1050A lithographic sheet. The arrangement is a twin cell design and samples were grained in the liquid contact mode. Graphite counter electrodes were employed and the aluminium sample to graphite electrode gap was 15 mm. A voltage of 19 V was used and the average current density was 3.1 kA/m2 giving a charge density of 93 kC/m$^2$. For the shorter time experiments these values were 3.5 kA/m$^2$ and 52 kC/m$^2$ respectively, these being on average slightly higher as the current decays as graining proceeds due to the smut formed on the samples' surfaces.

TABLE 4

Grading of Textured and Grained Samples

| Sample | Graining time | Grading* |
|---|---|---|
| 1050A normal as rolled | 15 s | X |
| 1050A normal as rolled | 30 s | ○○○ |
| run 3 (6 passes) | 15 s | ○ |
| run 4 (10 passes) | 15 s | ○○ |

*judged by SEM pictures, visual inspection and optical interferometer
X = Inadequate graining
○ = adequate
○○ = good
○○○ = excellent

TABLE 5

1050 Tandem Textured and Electrograined Material - 3D Roughness Measurements - Amplitude Parameters (Raw Data) 1.2 mm × 0.92 mm Area (1.65 μm Sampling)

| Alloy | Description | Side | Ra (μm) | Rq (μm) | Rz (μm) | Rt (μm) | Rsk | Rku | Surface Area Index | Volume (μm$^3$) × 10$^5$ |
|---|---|---|---|---|---|---|---|---|---|---|
| H19 mill finished | After 15 seconds electrograining | Labelled | 0.51 | 0.66 | 10.21 | 12.98 | −0.50 | 4.86 | 1.0560 | 12.92 |
| H19 mill finished | After 30 seconds electrograining | Labelled | 0.81 | 1.09 | 11.10 | 17.10 | −1.27 | 4.98 | 1.0746 | 15.91 |
| H19 run 3 (6 passes) | After 15 seconds electrograining | Labelled | 0.66 | 0.87 | 12.36 | 15.90 | −0.87 | 5.30 | 1.0556 | 14.59 |
| H19 run 4 (10 passes) | After 15 seconds electrograining | Labelled | 0.72 | 0.92 | 11.10 | 13.18 | −0.62 | 4.11 | 1.0539 | 16.90 |

Note:
(1) average of four measurements

Comments on Table 5 results: Comparing the standard 30 s sample and the 10 pass +15 s grained sample (run 4) the Rz, surface area and volume are fairly similar and the Ra is not too different but the skew is quite different. This sample qualifies as at least acceptable.

EXAMPLE 4

Further work has been carried out with an alternative type of textured roll surface where the roll surface was prepared by electro chrome deposition. This is a known and commercially available surface texturing process which has been used with metal reduction to texture steel sheet. The electro chrome deposition process leaves the roll surface with many positive spherical features which, if they are all at similar height above the roll surface are ideal for the elastic or tandem texturing process. This is because a higher proportion of the surface is usable to imprint the sheet surface with negative features. FIG. 7 shows the roll surface treated with the electro chrome deposition process.

The surface parameters for this are as follows (The shadings in FIG. 7 are contours of height and the consistency of heights of positive features is indicated by the fact that they have the same shading):

Ra=1.69 microns

Rq=1.98

Rz=17.49

Rt=24.55

6016 alloy strip of 1 mm thickness and H9 temper was processed through these rolls using a carefully controlled force of 50 N/mm and after ten passes the strip was as shown in FIG. 8.

The parameters for this surface are as follows:

| Ra (μm) | Rq (μm) | Rz (μm) | Rt (μm) | Rsk | Rku | Surface Area index | Volume ($\mu m^3$) | Peaks/cm |
|---|---|---|---|---|---|---|---|---|
| 0.49 | 0.61 | 6.69 | 11.56 | −0.1 | 3.27 | 1.0262 | 13.95 | 144 |

EXAMPLE 5

A sample of final rolled lithosheet of gauge 0.28 mm was rolled as in the previous example with a Pretex finish. The load used was 17 N/mm. No measurable extension was produced by any of the ten passes used.

It is important for lithographic sheet to be able to retain water on the surface and a parameter that is key to this is the total volume of closed voids on the surface. This is a value derived from the Wyko interferometry data where a datum plane is progressively raised through the surface and the volume of voids (or in practice fountain solution that is trapped in place by the offset blanket roll) is calculated. The method is described by Pfestorf, M, Engel, U and Geiger, M in Blech Rohre Profile P 689-693, 43 (1996) 12. Using this technique the following was found for some typical commercial materials and the samples generated by the tandem texturing process.

| | Total volume of closed voids ($\mu m^3/m^2$) |
|---|---|
| 1050A mill finished commercially rolled lithographic sheet | $2\text{-}3 \times 10^{10}$ |
| Commercially electrograined lithographic plate | $\sim 4\text{-}6 \times 10^{11}$ |
| 1050A EDT finished roll (as Example 3) | |
| H19 mill finished + 15 s graining | $2.47 \times 10^{11}$ |
| H19 mill finished + 30 s graining | $3.60 \times 10^{11}$ |
| H19 + 6 passes + 15 s graining | $4.99 \times 10^{11}$ |
| H19 + 10 passes + 15 s graining | $3.81 \times 10^{11}$ |
| 6016A EDT finished roll (as Example 1) | |
| 50 N/mm (2 passes) | $4.10 \times 10^{11}$ |
| 50 N/mm (4 passes) | $6.08 \times 10^{11}$ |
| 35 N/mm (4 passes) | $4.01 \times 10^{11}$ |
| 25 N/mm (7 passes) | $6.02 \times 10^{11}$ |
| 1050A Pretex finish sheet (described above, 10 passes) | $2.56 \times 10^{11}$ |

It can be seen that by choosing a suitable roll surface finish closed void volumes of the appropriate order can be achieved either with or without graining. Again tandem texturing plus reduced graining (15 s relates to approximately half the charge used for full graining in this case of 30 s) has allowed suitable finishes to be achieved that will also have the good adhesion characteristics required in lithographic printing for the organic film of the image area.

The invention claimed is:

1. A method of texturing a metal sheet or strip, which method comprises three or more texturing passes each of which is performed by passing the sheet or strip between a plurality of pairs of rollers, wherein at least one of each pair of rollers has a textured pattern on the surface thereof and the textured pattern is transferred to the sheet or strip during each texturing pass, wherein the textured surface on the sheet or strip resulting from each pass overlaps with that from the other passes to form a final textured pattern, wherein the average area of coverage of the surface of the sheet or strip during each pass is less than 35% and wherein there is substantially no reduction in the thickness of the sheet or strip during each pass.

2. A method according to claim 1, wherein the rollers are present in a tandem arrangement.

3. A method according to claim 1, wherein a load is applied during each pass and wherein the load applied during each pass is from 20% to 95% of that which would cause a measurable thickness reduction.

4. A method according to claim 3, wherein the load applied during each pass is from 50% to 80% of that which would cause a measurable thickness reduction.

5. A method according to claim 1, wherein the average area of coverage is between 5% and 25%.

6. A method according to claim 1, comprising between five and seven texturing passes.

7. A method according to claim 1, wherein each texturing pass produces a different textured pattern on the sheet or strip surface.

8. A method according to claim 1, further comprising solution heat treating the strip immediately after texturing.

9. A method according to claim 1, further comprising the step of graining the sheet or strip before and/or after the texturing step.

10. A method according to claim 9, wherein the graining step is carried out after the texturing step.

11. A method according to claim 9, wherein the graining step comprises applying an organic or inorganic layer to the surface.

12. A method according to claim 11, wherein the layer comprises a Type A sol which is itself derived from an inorganic precursor.

13. A method according to claim 11, wherein the layer is hydrophilic.

14. A method according to claim 13, wherein the hydrophilic layer is formed by contacting the strip with a liquid comprising a silicate solution in which particulate material is dispersed.

15. A method according to claim 9, wherein graining is from 1% to 80% of that performed on commercial single rolled aluminium sheet.

16. A method according to claim 9, wherein the graining is carried out by electrograining in a nitric or hydrochloric acid based electrolyte.

17. A method according to claim 1, wherein the total length of the strip is increased by between 0 and 0.5% during texturing.

18. A method according to claim 17, wherein the total length of the strip is not increased during texturing.

19. An apparatus for texturing a metal sheet or strip, the apparatus comprising:

(a) a plurality of pairs of rollers, wherein at least one of each pair of rollers has a textured pattern on the surface thereof; and (b) means for providing three or more texturing passes, and (c) means for applying pressure to the rollers, wherein the pressure applied is such that there is substantially no reduction in the thickness of the sheet or strip during each pass, wherein, in use, the textured pattern is transferred to the surface of a sheet or strip passing between each pair of rollers and the textured pattern on the sheet or strip resulting from each pass overlaps with that from the other passes to form a final textured pattern and wherein, in use, the rollers are capable of providing an average area of coverage of the surface of sheet or strip of less than 35%.

20. An apparatus according to claim 19, wherein the rollers are present in a tandem arrangement.

* * * * *